US005448007A

United States Patent [19]

Hou

[11] Patent Number: 5,448,007

[45] Date of Patent: Sep. 5, 1995

[54] ORNAMENTAL DISPLAY WITH CANTILEVERED FOLLOWER

[75] Inventor: Jack Hou, Taipei, Taiwan

[73] Assignee: Giftec, Ltd., Alexandria, Va.

[21] Appl. No.: 285,302

[22] Filed: Aug. 3, 1994

[51] Int. Cl.[6] ..... G10F 1/06

[52] U.S. Cl. ..... 84/95.2; 446/298; D17/24

[58] Field of Search ..... 84/94.1, 94.2, 95.1, 84/95.2; 446/298, 303; D17/24

[56] References Cited

U.S. PATENT DOCUMENTS

| | | | |
|---|---|---|---|
| Re. 33,933 | 5/1992 | Hou | 84/95.2 |
| 4,890,828 | 1/1990 | Hou | 446/238 |
| 4,939,944 | 7/1990 | Hou | 74/49 |
| 5,020,409 | 6/1991 | Hou | 84/95.2 |
| 5,081,899 | 1/1992 | Hou et al. | 84/95.2 |
| 5,088,373 | 2/1992 | Hou | 84/95.2 |
| 5,157,217 | 10/1992 | Feng | 84/95.2 |

*Primary Examiner*—Howard B. Blankenship

*Assistant Examiner*—Cassandra Spyrou

*Attorney, Agent, or Firm*—Bacon & Thomas

[57] ABSTRACT

An ornamental display is disclosed in which an ornament is attached to a follower arm which is integrally formed as a single unit with the follower body. The follower body is guided by one or more guide rods attached to either a cover or a base. The base supports a music box mechanism which imparts reciprocating movement to the follower via a crank mechanism which is rotated by the rotating drum of the music box mechanism and which engages the follower body. The guide rods slidably extend through the follower body so as to limit the reciprocating movement of the follower to translational movement. The ornament may be attached at any location along the follower arm to preserve flexibility regarding the positional relationship between the ornament and the music box mechanism. The device is simplified over the prior art devices, since the follower arm extends from the follower body in cantilevered fashion such that the distal end of the follower arm is unsupported.

11 Claims, 3 Drawing Sheets

ORNAMENTAL DISPLAY WITH CANTILEVERED FOLLOWER

BACKGROUND OF THE INVENTION

The present invention relates to a movable ornamental display, more particularly such a movable display having a cantilevered follower arm to transfer motion from a power source to the ornamental display.

Ornamental display assemblies having movable elements are, of course, well known in the art. Such assemblies may assume various configurations, such as a rotating carousel with one or more ornamental horses which may move vertically up and down as the carousel rotates. It is also known to provide a stationary base assembly on which one or more ornamental objects are mounted and which may move with respect to the stationary base.

It is also known to provide such an ornamental display with a power source comprising a music box assembly. The known music box assemblies typically have a rotating drum portion to which may be attached a crank mechanism which imparts movement to the display assembly via a follower. Attachment of the display ornament directly to the follower limits the relative positioning between the ornamental object and the power source, which may limit the aesthetic aspects of the display device. It is also known to attach a separate arm to the follower and to attach the display ornament to this arm in order to vary the relative positions between the display ornament and the music box mechanism. However, such known devices have necessitated the fabrication of the follower and arm from separate pieces and have necessitated a guide mechanism engaged with the distal end of the arm. This results in a mechanism which is unduly complex and time consuming to assemble.

SUMMARY OF THE INVENTION

An ornamental display is disclosed in which an ornament is attached to a follower arm which is integrally formed as a single unit with the follower body. The follower body is guided by one or more guide rods attached to either a cover or a base. The base supports a music box mechanism which imparts reciprocating movement to the follower via a crank mechanism which is rotated by the rotating drum of the music box mechanism and which engages the follower body. The guide rods slidably extend through the follower body so as to limit the reciprocating movement of the follower to translational movement. The ornament may be attached at any location along the follower arm to preserve flexibility regarding the positional relationship between the ornament and the music box mechanism. The device is simplified over the prior art devices, since the follower arm extends from the follower body in cantilevered fashion such that the distal end of the follower arm is unsupported.

The guide rods may be attached to the inner portion of the cover such that they extend downwardly from a top, or laterally from a side of the cover through the follower body. Alternatively, the guide rods may be attached to the base such that they extend upwardly from the base. In each case, the follower body is slidably attached to the guide rods so as to undergo translational reciprocating movement as the music box drum rotates.

The ornamental display may be mounted on a tappet rod which extends through the cover and which is attached to the follower arm.

DETAILED DESCRIPTION OF THE PREFERRED EMBODIMENTS

Figure 1:
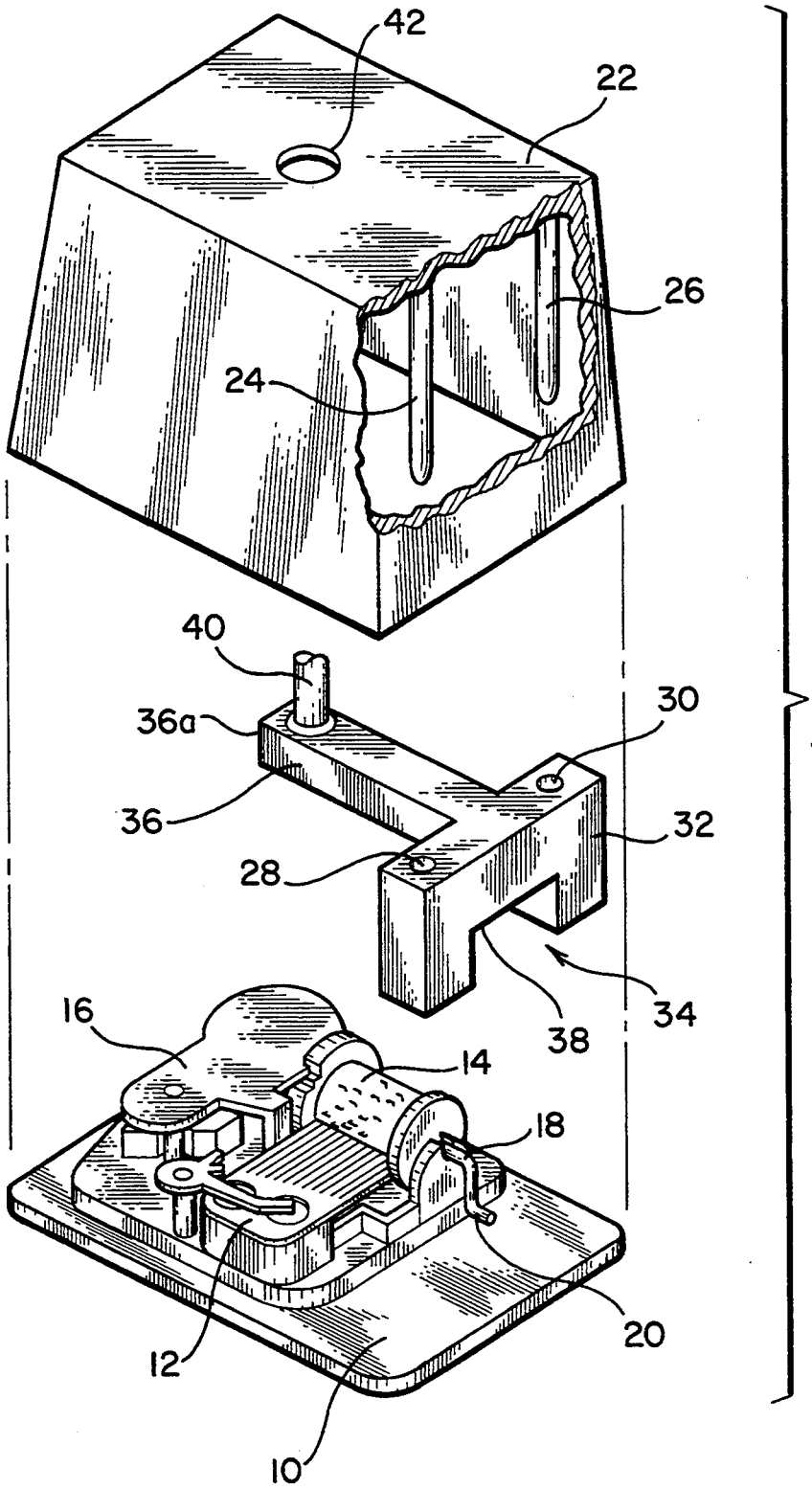
FIG. 1 is an exploded, perspective view of a first embodiment of the ornamental display device according to the present invention.

The ornamental display according to the present invention comprises a base 10 on which is mounted a known music box assembly 12 which has a rotatable drum portion 14 rotated by a wind-up mechanism 16.

A crank 18 is operatively connected to the rotating drum 14 so as to rotate therewith. Crank 18 has eccentric portion 20 which moves in a circle about the crank end 18 attached to the drum 14 as the drum 14 rotates.

A cover 22 which defines a hollow interior is attached to the base 10 so as to enclose the music box mechanism 12 and the crank 18. Cover 22 may assume any configuration so as to provide the desired aesthetic effects to the ornamental device. In a first embodiment of the invention, guide rods 24 and 26 each have an end attached to the cover 22 so as to extend generally downwardly from an upper portion of the cover 22.

The guide rods 24 and 26 slidably extend through openings 28 and 30 formed in the follower body 32. Follower body 32 forms a part of the follower 34, which also includes a cantilevered arm 36 extending from the follower body 32 such that the distal end **36*a* is unsupported. The follower 34 may be formed as an integral unit, with the follower body 32 and the follower arm 36 molded integrally from a plastic material, or the like. As can be seen, follower arm 36 extends outwardly from the follower body so as to be non-coplanar with a movement plane in which the follower body 32** moves in reciprocating fashion.

Follower body 32 defines a follower surface 38 which contacts eccentric portion 20 of crank 18. As can be seen, rotation of eccentric crank portion 20 in contact with follower surface 38 will cause reciprocating movement of the follower 34 along the guide rods 24 and 26. Since the guide rods 24 and 26 will prevent any rotational movement of the follower 34, its motion will be translational reciprocating movement.

Figure 2:
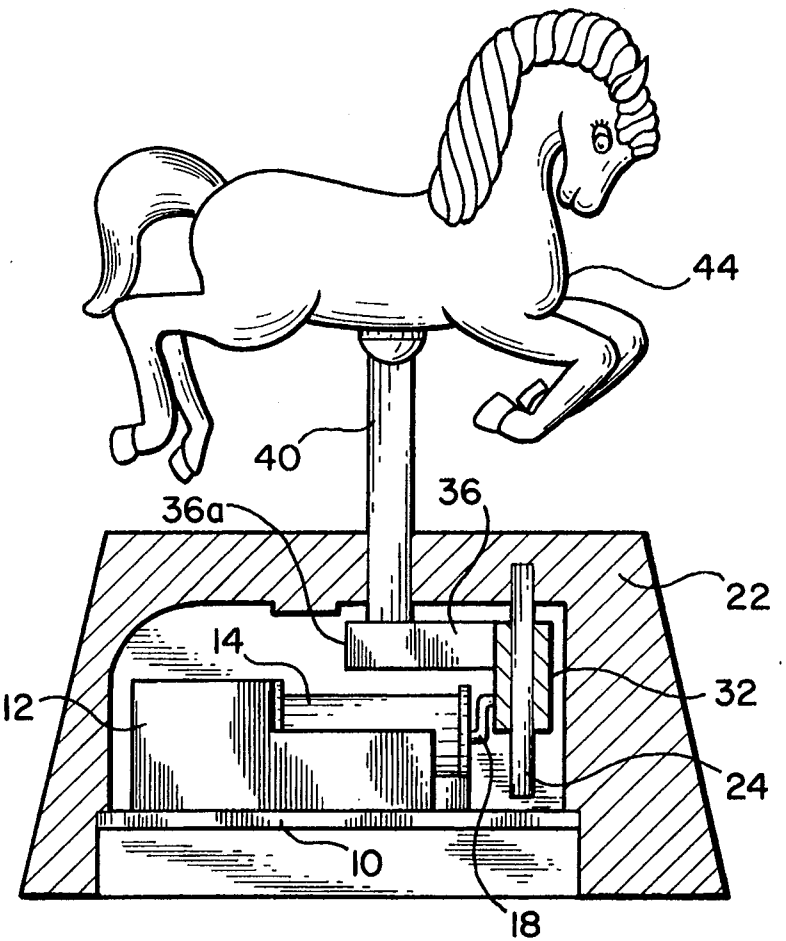
FIG. 2 is a cross-sectional view of the ornamental display of FIG. 1.

A tappet rod 40 is attached to the follower arm 36 and extends through hole 42 defined in an upper portion of the cover 22 such that a portion of the tappet rod extends exteriorly of the cover 22. As best seen in FIG. 2, the display ornament 44 is attached to the portion of tappet rod 40 which extends exteriorly of the cover 22.

Rotation of the drum 14 rotates the crank 18 which, due to the contact between the eccentric portion 20 and the follower surface 38 imparts a translational, reciprocating motion to the follower 34. This motion, in turn, is transmitted to the display ornament 44 via the follower arm 36 and the tappet rod 40.

Figure 4:
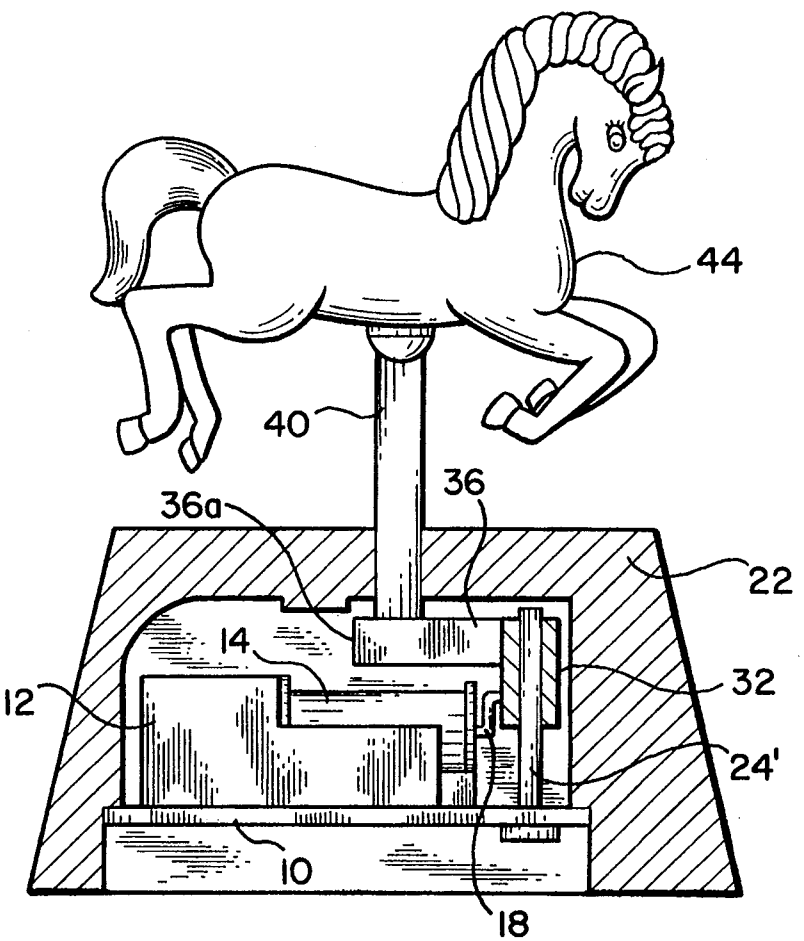
FIG. 4 is a cross-sectional view of the ornamental display of FIG. 3.
Figure 3:
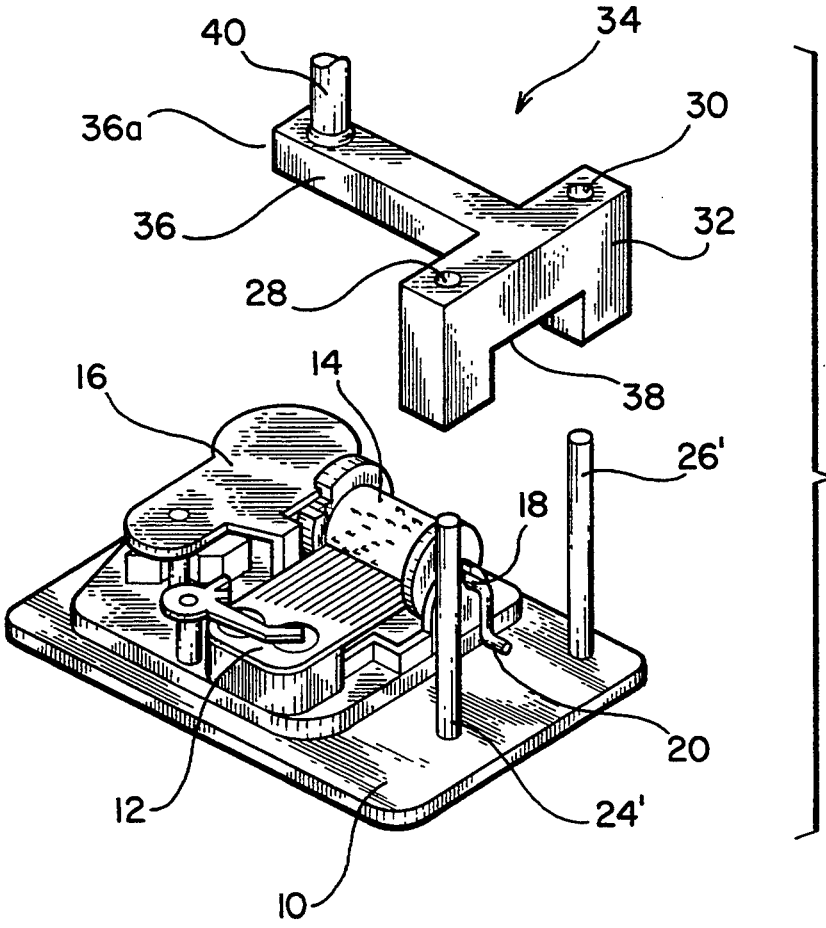
FIG. 3 is a partial, exploded, perspective view of an alternative embodiment of the ornamental display according to the present invention.

An alternative embodiment is illustrated in FIGS. 3 and 4. This embodiment is substantially the same as the previously described embodiment, except for the mounting of the guide rods 24' and 26'. In this particular embodiment, the guide rods 24' and 26' each have an end attached to the base 10 so as to extend upwardly therefrom. As in the previously described embodiment, the follower 34 is slidably guided by the guide rods 24' and 26' such that rotation of the drum 14 and crank 18 causes translational reciprocating movement of the follower 34, which movement is imparted to the display ornament 42.

It is also possible to impart a lateral movement to the display ornament by attaching the guide rods to a side of the cover 22 such that the guide rods extend inwardly into the interior of the cover. In this instance, follower body 32 may have an elongated slot defining opposite surfaces which contact the eccentric portion 20 of crank 18 to impart lateral reciprocating motion to follower 34.

The foregoing description of the invention is presented for illustrative purposes only and should not be construed as in any way limiting this invention, the scope of which is defined solely by the appended claims.

I claim:

1. An ornamental display comprising:

a) a base;

b) a music box mechanism located on the base and having a rotating portion;

c) a crank mechanism attached to and rotatable with the rotary portion of the music box mechanism;

d) a cover located on the base so as to enclose the music box mechanism;

e) guide means attached to one of the base and the cover;

f) a follower in contact with the crank mechanism such that rotation of the crank mechanism causes reciprocating movement of the follower in a movement plane, the follower comprising a follower body slidably located on the guide means and a cantilevered follower arm extending from the follower body obliquely to the movement plane, such that a distal end of the follower arm is unsupported;

g) a support attached to the cantilevered follower arm and extending through the cover such that a portion of the support extends exteriorly of the cover; and, h) a display ornament attached to the support portion extending exteriorly of the cover.

2. The ornamental display of claim 1 wherein the follower body defines at least one follower surface in contact with the crank mechanism.

3. The ornamental display of claim 1 wherein the guide means comprises at least one guide rod.

4. The ornamental display of claim 1 wherein the guide means comprises a plurality of guide rods.

5. The ornamental display of claim 1 wherein the guide means is attached to the cover.

6. The ornamental display of claim 5 wherein the guide means comprises at least one guide rod having an end attached to the cover.

7. The ornamental display of claim 5 wherein the guide means comprises a plurality of guide rods, each of said guide rods having an end attached to the cover.

8. The ornamental display of claim 1 wherein the guide means is attached to the base.

9. The ornamental display of claim 8 wherein the guide means comprises at least one guide rod having an end attached to the base.

10. The ornamental display of claim 8 wherein the guide means comprises a plurality of guide rods, each of said guide rods having an end attached to the base.

11. The ornamental display of claim 1 wherein the follower arm is integrally formed with the follower body.

* * * * *